US008646607B1

(12) United States Patent
Dana

(10) Patent No.: US 8,646,607 B1
(45) Date of Patent: Feb. 11, 2014

(54) ELECTRONIC DEVICE ACCESSORIES PACKAGING SYSTEM AND METHODS THEREOF

(76) Inventor: Eddie Dana, Brooklyn, NY (US)

( * ) Notice: Subject to any disclaimer, the term of this patent is extended or adjusted under 35 U.S.C. 154(b) by 27 days.

(21) Appl. No.: 12/113,129

(22) Filed: Apr. 30, 2008

(51) Int. Cl.
*B65D 85/00* (2006.01)

(52) U.S. Cl.
USPC ..... 206/461; 206/702

(58) Field of Classification Search
USPC ..... 206/461, 470, 327, 702, 462–463, 467, 206/471, 779, 806
See application file for complete search history.

(56) References Cited

U.S. PATENT DOCUMENTS

| | | | | |
|---|---|---|---|---|
| 3,297,289 | A | 1/1967 | Raus | |
| 3,392,823 | A | 7/1968 | Green et al. | |
| 4,165,805 | A | 8/1979 | Fethke et al. | |
| 4,179,029 | A | 12/1979 | Fethke et al. | |
| 4,423,811 | A | 1/1984 | Knapp | |
| 4,431,717 | A | 2/1984 | Kikuchi | |
| 4,637,516 | A | 1/1987 | de Roure | |
| 4,702,374 | A | 10/1987 | Kelner | |
| 4,719,698 | A | 1/1988 | Ninomiya et al. | |
| 4,872,551 | A | 10/1989 | Theros | |
| 4,899,877 | A | 2/1990 | Kiernan | |
| 4,925,025 | A | 5/1990 | Anten et al. | |
| 5,048,677 | A | 9/1991 | Pedracine | |
| 5,129,516 | A | 7/1992 | Theros | |
| 5,172,806 | A | 12/1992 | Mickelberg | |
| 5,279,417 | A | 1/1994 | Seaton | |
| 5,289,916 | A | 3/1994 | Mickelberg | |
| 5,348,145 | A | 9/1994 | Steinfels, III | |
| 5,411,138 | A | 5/1995 | Klawiter | |
| 5,435,447 | A | 7/1995 | Weatherford et al. | |
| 5,595,295 | A | 1/1997 | Lin | |
| 5,622,258 | A | 4/1997 | Bublitz et al. | |
| 5,636,741 | A | 6/1997 | OKeefe | |
| 5,803,253 | A | 9/1998 | Zakarian | |
| 5,816,401 | A | 10/1998 | Vasudeva et al. | |
| 5,871,099 | A | 2/1999 | Mellenthin | |
| 6,126,008 | A | 10/2000 | Cox | |
| 6,241,092 | B1 | 6/2001 | Vasudeva | |
| 6,265,332 | B1 | 7/2001 | Yoshida et al. | |
| 6,311,839 | B1 | 11/2001 | Lo | |
| 6,349,830 | B1 | 2/2002 | Le Bron | |
| 6,401,932 | B1 * | 6/2002 | Weinstein et al. | 206/779 |
| 6,467,617 | B1 | 10/2002 | Chen | |
| 6,727,826 | B1 | 4/2004 | Ki Kwan et al. | |
| 6,814,238 | B2 * | 11/2004 | Lee | 206/722 |
| D504,811 | S | 5/2005 | Haingaertner | |
| 6,899,222 | B2 | 5/2005 | Jones et al. | |
| 6,953,117 | B2 | 10/2005 | Schein et al. | |
| 6,968,950 | B2 * | 11/2005 | Eisenbraun | 206/461 |
| 6,993,803 | B2 | 2/2006 | Chan et al. | |
| 2002/0162771 | A1 | 11/2002 | Van Wagenen et al. | |
| 2003/0052033 | A1 | 3/2003 | Schwester | |
| 2003/0205500 | A1 | 11/2003 | Schein et al. | |
| 2004/0149615 | A1 | 8/2004 | Eisenbraun | |
| 2004/0222118 | A1 * | 11/2004 | Melgaard | 206/461 |
| 2005/0172492 | A1 | 8/2005 | Blaustein et al. | |
| 2005/0217115 | A1 | 10/2005 | Blaustein et al. | |
| 2005/0284788 | A1 * | 12/2005 | Elliott et al. | 206/461 |
| 2006/0011505 | A1 * | 1/2006 | Chen | 206/461 |
| 2007/0056872 | A1 * | 3/2007 | Begim | 206/461 |
| 2008/0289297 | A1 * | 11/2008 | Tsang | 53/167 |
| 2009/0114565 | A1 * | 5/2009 | Dhuru et al. | 206/780 |

* cited by examiner

*Primary Examiner* — David Fidei
*Assistant Examiner* — Robert Poon
(74) *Attorney, Agent, or Firm* — Connie R. Masters

(57) ABSTRACT

An electronic device accessories packaging system and methods of manufacturing, distributing and retailing the electronic device accessories packaging are disclosed.

8 Claims, 6 Drawing Sheets

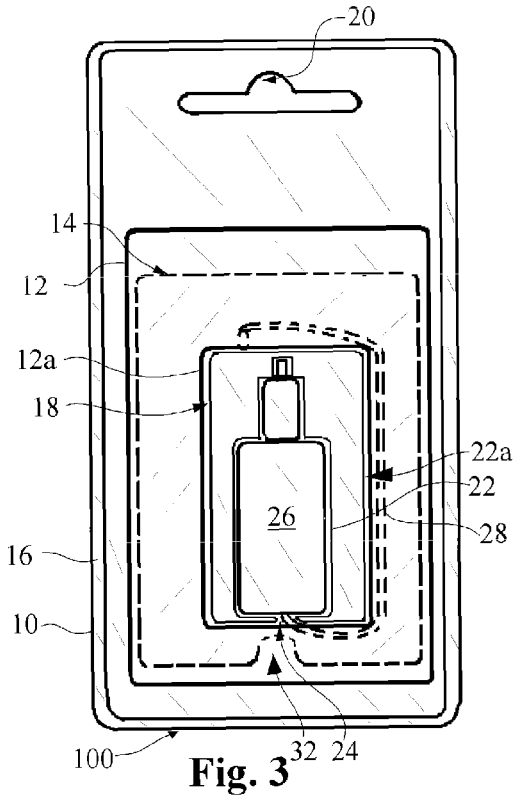
Fig. 3
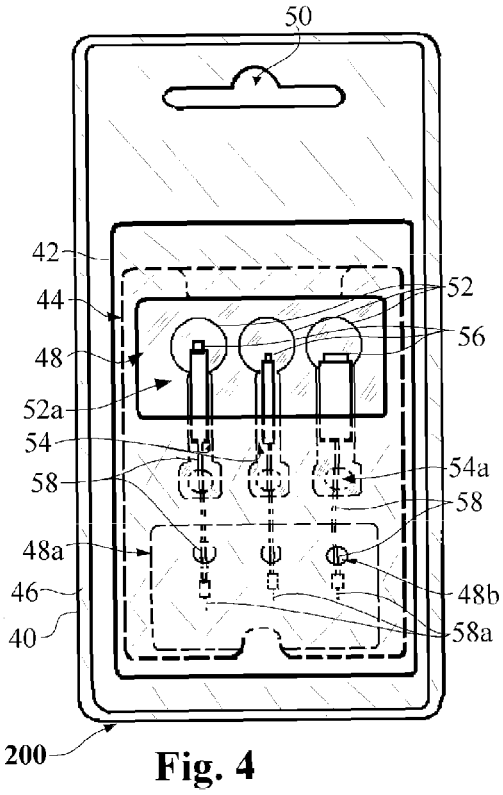
Fig. 4
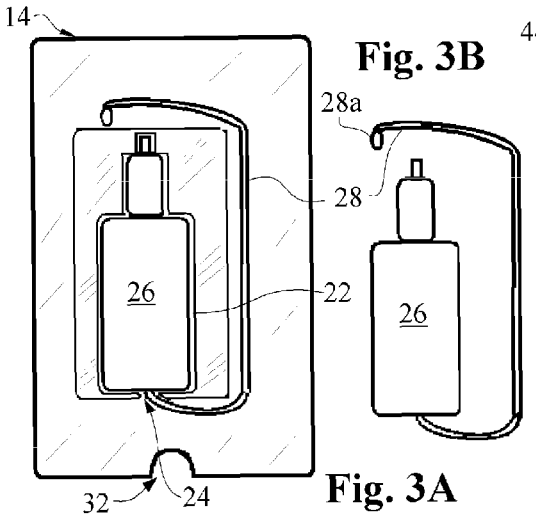
Fig. 3B
Fig. 3A
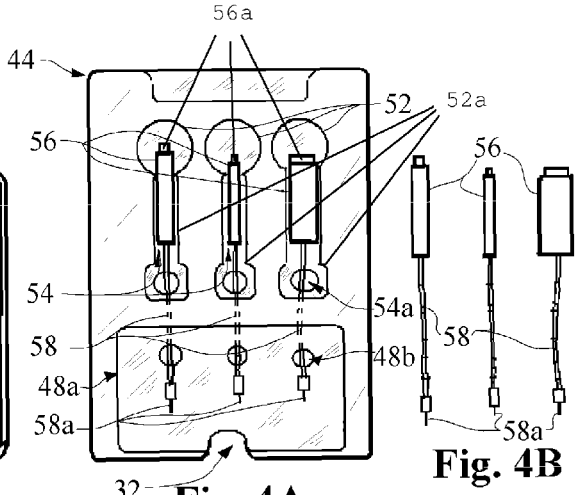
Fig. 4A
Fig. 4B

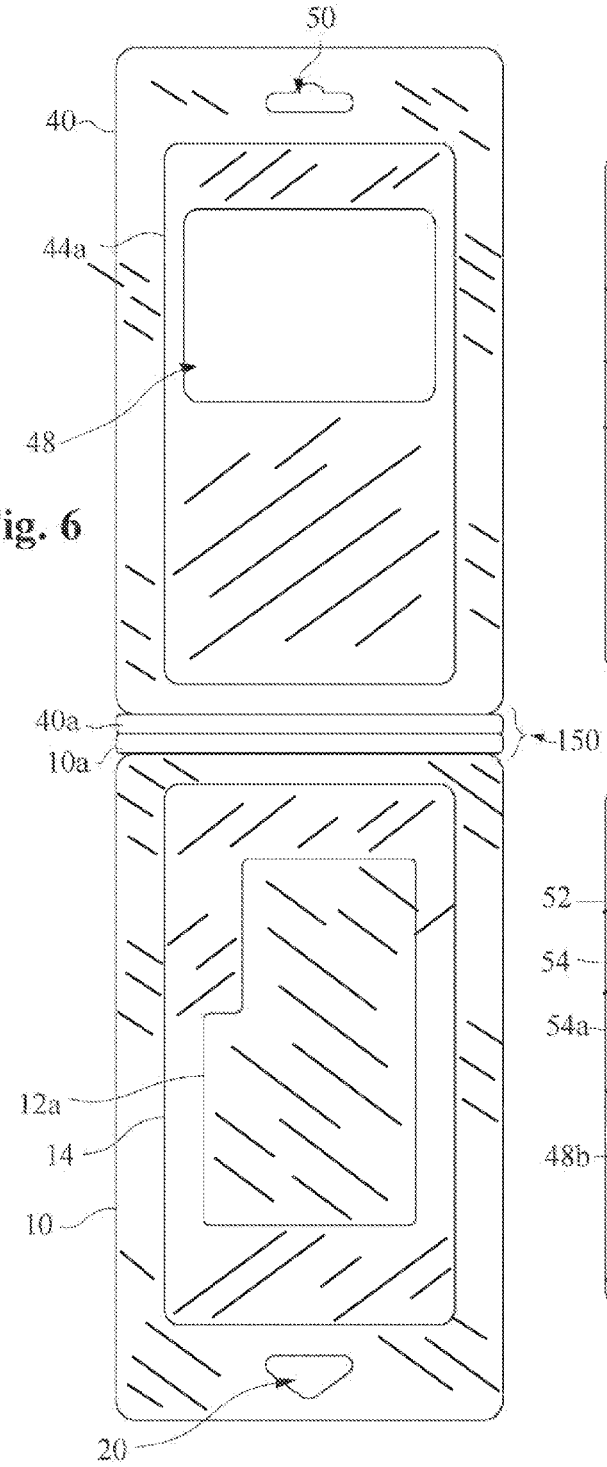
Fig. 6
Fig. 6A
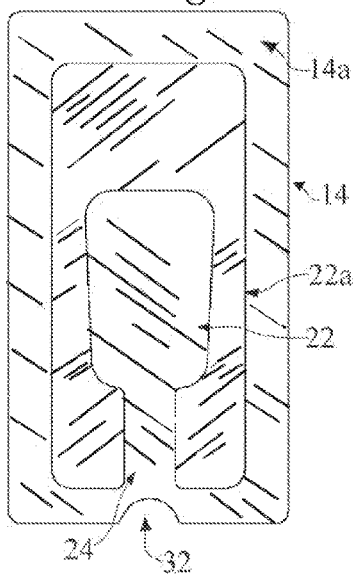
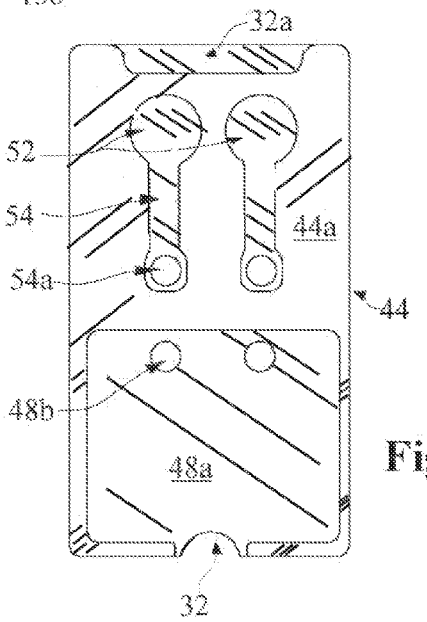
Fig. 6B

ELECTRONIC DEVICE ACCESSORIES PACKAGING SYSTEM AND METHODS THEREOF

FIELD OF INVENTION

This invention generally relates to packaging for electronic device accessories, especially portable electronic device accessories, intended for merchandising display.

BACKGROUND OF THE INVENTION

Typically, electronic devices, including portable electronic devices, lack uniform or compatible accessory systems. Such devices typically have dedicated shapes and requirements for accessory connectors. For example, such accessory connectors may be manufactured to fit and work with just one type and brand of electronic device. Throughout this disclosure, the terms "dedicated connector" and "accessory connector" may be used to connote "a connector of an accessory poduct for use with a particular electronic device."

In general, the current prevalence of dedicated connectors poses several disadvantages for consumers and retailers. First, many consumers dislike the confusion caused by the lack of uniformity and compatibility of accessories for electronic devices. Finding the right accessory which corresponds to the right connector for the right electronic device may be considered to be a chore by many consumers. This may be because more consumers are not inherently interested in how accessories connect to electronic devices, but care only that the accessories work with their electronic devices. In particular, small electronic devices may use accessories and connectors that are themselves small and lack distinctive features noticeable to consumers. Thus, in order to find the right accessories and connectors, consumers must match them to model numbers that, too, are almost always in formats lacking inherent distinctiveness or interest to consumers, e.g., "MOTOROLA T300p."

Second, the prevalence of dedicated connectors often means that retailers feel they must stock and display accessories with a variety of different accessory connectors for many of the electronic devices they carry. This can amount to dozens of different accessories and accessory connector types needing to be stocked and displayed. The disadvantage to retailers is that to the extent consumers rely on sales staff help to guide them through the maze of accessories and connectors, such service to consumers may represent a drain on retailer resources (resulting in higher prices to consumers), as well as resources diverted from the sale of items leading to greater production revenue.

Third, for all of the reasons listed above, consumers may more likely err in the purchase of electronic device accessories, resulting in consumer disappointment and inconvenience. To the extent retailers make good these inevitable consumer mistakes, retailers may need to absorb increased packaging and labor costs to process returns.

To overcome the foregoing problems, there have been a number of developments in the past to provide packaging denoted herein as "try me" packaging. Such packaging may generally be sealed to prevent shoppers from handling the merchandise within the package. In the specific case of accessories for electronic devices, the packaging may comprise one or more openings to permit shoppers to gain access to a portion of the merchandise. Thus, shoppers may now feel the quality of the accessories and test the accessories with an electronic device to determine its suitability for the device. By means of "try me" packaging, this may be done without breaking the seal of the packaging, purchasing the merchandise, or rendering it unfit for subsequent sale. "Try me" packaging often may eliminate the need for consumers to match model numbers on accessories with electronic devices, in turn, enhancing the shopping experience, reducing the need for sales help, and reducing mistaken purchases and returns. Moreover, advantageously, the cost of returns for retailers may be much reduced.

A number of different disclosures reveal strategies for providing "try me" packaging systems. However, these disclosures fall short of solving all of the problems presented by the merchandising of accessories for portable electronic devices.

Thus, in one example, Kelner, U.S. Pat. No. 4,702,374, disclosed a package assembly with a testing feature for an illumination product. The particular issue addressed by Kelner was the problem of determining whether merchandise contained within a sealed package, specifically a flashlight and the like, was in good working order. Kelner's package assembly provided an opening in the sealed package for an electrical connector to be plugged into an electrical outlet to test whether the illumination product within the package would light up or not. However, Kelner failed to address the problem of testing the compatibility of a packaged accessory with an electronic device.

In a further example, Kiernan, U.S. Pat. No. 4,899,877, disclosed a merchandising package for tools, such as screwdrivers. Using Kiernan's merchandising package, a retailer may securely display tools for sale in such a way that shoppers may manipulate the tools. For example, shoppers may turn the handle of a screwdriver in order to determine whether they like its feel. However, Kiernans's disclosure is not directed to electronic device accessories and, further, exposes the packaged merchandise in a way unsuited to accessories for electronic devices.

In a yet further example, Vasudeva, U.S. Pat. No. 6,241,092, disclosed a merchandising display for tools, such as screwdrivers, allowing them to be effectively fully exposed to handling by shoppers, yet securely fastened to a display rack. However, Vasudeva's disclosure does not appear to be directed to electronic device accessories and, in fact, exposed the packaged merchandise in a way unsuited to accessories for electronic devices.

Lebron, U.S. Pat. No. 6,349,830, disclosed a merchandising package for replacement electronic device accessories, such as battery packs for cordless telephone handsets. Lebron attempts to solve the problem of enabling consumers to check the compatibility of replacement accessories by bringing the spent accessory to the store to try with a dummy plug matching interface, but without removing the accessory or its connector from a sealed merchandising package. However, Lebron does not accomplish this by using a traditional "try me" feature. Instead, Lebron, uses one or another of two types of simulated or dummy plug matching coupling interfaces: (1) a dummy coupling interface molded into the outer plastic surface wall of the package, simulating the interface for mating with the connector of the accessory within the package; or (2) a opening in the outer plastic surface of the package exposing the actual plug matching coupling interface for mating with the packaged accessory's connector. Lebron's disclosure has several apparent shortcomings. It is unclear whether connector interfaces for electronic device accessories can practically be molded into a cheap plastic merchandising package to a degree of refinement enabling them to fulfill the purpose of testing compatibility with an electronic device. This is especially true in the case of male connectors, where the coupling interface has to be a molded protrusion projecting outward from the outer plastic surface wall of the package, and has to be fine enough to fit properly into the small, refined plug of an electronic device. Further, unlike traditional "try me" displays, where the connector to be tested is typically nested and horizontally positioned within a recess of the outer plastic surface wall of the merchandising package, Lebron's disclosure positions the dummy plug matching interface connector outwardly. With this approach the connector is shielded from damage and its electrical contact surfaces are shielded from contamination. However, positioning the connector outwardly, especially in the cast of male connectors, exposes it to greater damage and contamination.

In yet another example, Schein et al., U.S. Pat. No. 6,953,117, disclosed sales packaging for electric storage batteries featuring a specialized "try me" feature. According to Schein et al.: (1) the sales package consists of a blister pack positioned on a portion of the cardboard backing of a hanging rack display; (2) the merchandise is sealed within the blister pack, except for an opening through the cardboard backing to permit the connector cord of the packaged accessory to exit the rear of the sealed blister pack; (3) the connector cord threads up the back of the sales package; and (4) the connector at the end of the cord pokes through to the front of the non-blister pack, display portion of the cardboard backing. The disadvantages of Schein et al. appear to be that the overall size of the sales package must be increased in order to accommodate a cardboard backing portion that is larger than the blister pack containing the merchandise, and the connector of the accessory being sold may be highly exposed to damage and contamination. Larger packaging also translates to increased cost of packaging and reduced shelf space for most electronics retailers.

Eisenbraun, U.S. Pat. No. 6,968,950, disclosed an interactive merchandising package sealed on all sides except for a "try me" feature at the front enabling shoppers to test the compatibility of their portable electronic devices with the connector of the accessory within the package. The claimed inventive feature of Eisenbraum is placement of the "try me" feature in a recess at the front of the merchandising package. The recess provides protection against damage for the exposed connector. Placement at the front of the package enables shoppers to use the "try me" feature without removing the package from a merchandise display rack. The shortcoming of Eisenbraum is that placement of the "try me" feature at the front of the merchandising package (1) obscures the product display and (2) detracts from the overall appearance of the package, since connectors, for example, are generally the least attractive parts of portable electronic device accessories.

As may be evident from the above, even though a great number of "try me" packages have been disclosed and may exist in the marketplace, each of them may have features that detract from the needs of both consumers and of merchandisers. Consequently, there is a need for new and improved "try me" packages, especially of the type most suitable as packaging for electronic device accessories intended for merchandising display.

SUMMARY OF THE INVENTION

The current disclosure is directed to merchandise packaging of the clamshell variety incorporating a "try me" feature in a back wall portion of a packaging system. The various embodiments disclosed herein are meant to be illustrative of the general concept and are not intended to limit any facet of this disclosure.

The packaging may be sealed on all sides to prevent shoppers from handling the accessories within the package, except for one or more consumer-accessible openings on the rear side of the package. The consumer-accessible openings permit shoppers to gain access to a portion of the accessories within, such as a desired accessory connector. Thus, shoppers are able to test the accessories with an electronic device to determine its suitability for the device, without breaking the seal of the package, purchasing the accessories, or rendering them unfit for subsequent sale.

For example, in an embodiment of the disclosure, a packaging system comprises, in combination, a back assembly and a front assembly comprising a combination of elements. For example, the packaging system may be a clamshell type with each side of the clamshell comprising a back assembly and front assembly.

In the back assembly, a primary member has at least one consumer-accessible opening. The primary member has a portion of one or more secondary members (such as internal sub-packages) proximate to a portion of an opposite (inner) side of the primary member. Further, a portion of the one or more secondary members may include one or more securing members (such as necking pre-defined in the internal sub-packages to pinch a portion of any one of one or more connector accessory devices). These securing members secure a portion of one or more primary accessory devices (such as the connector accessory devices) to a predefined level of securing the one or more inner primary accessory devices on a side of the one or more secondary members. In other words, in an example, the necking may be varied according to the size of the connector. Each of the primary accessory devices has an end accessable to one or more secondary device accessories. Thus, for example, the secondary device accessory may be any type of power adaptor or headset having an input or output corresponding to the end of the connector accessory device that might be displayed within the front assembly (described below). Further, an opposite end of each of the primary accessory devices is located in a portion of the at least one accessible opening. The opposite end of the primary accessory devices is associated with a portion of at least one tertiary device (such as for example a cellular telephone, MP3 player or laptop computer).

In the front assembly, at least visual identification of the at least one secondary device accssory is permitted. For example, the identification might show model numbers and promotional materials as described. At least a portion of the one or more front members may include one or more securing members configured to secure a portion of the at least one secondary device accessory to a predefined level of securing the one secondary device accessory to at least a portion of the one or more front members (for example, necking as described above). Further, at least a portion of the back member may be coupled to a portion of one or more of the front members (as described above regarding the back assembly) prior to coupling the back assembly to the front assembly to provide the packaging system. In other words, by the way of example, prior to folding and sealing a clamshell package.

In accordance with another embodiment of this disclosure, a method for distributing and merchandising a packaging system is disclosed. The method comprises a number of steps. In one step at least one manufacturer provides the packaging system according to the above description of a packaging system. Thus, in an example, as is commonly done, several manufacturers may be involved in providing elements of the packaging system described above. In another step, the back assembly may be coupled to the front assembly (thus, for example, to seal the sides of a clamshell package together). In yet another step, the packaging system may be distributed to at least one merchandiser (for example, a wholesaler). In yet another step, the adaptor packaging system may be displayed to one or more consumers (as for example, by a retailer to shoppers). In yet another step, income is received from one or more consumers to satisfy according to a predetermined level of satisfaction of one or more of the following: at least one manufacturer, at least one merchandiser, and one or more consumers. In other words, for example, each entity (or individual) involved in a transaction associated with the packaging system would form part of an economic chain associated with the packaging system and its contents.

According to another embodiment of the disclosure, an electronic device accessories packaging system is disclosed. In this embodiment, in an aspect, one or more back packaging members have one or more channels to secure a portion of one or more accessory connectors. Further, the electronic device accessory has a cord, and an end of the cord has a plug configured to couple to an opposite end of the one or more accessory connectors.

In yet another aspect, each of the one or more accessory connector members has a cord, and an end of the cord has a plug configured to couple to a corresponding socket of one or more consumer electronic devices. Alternatively, in lieu of an accessory connector consisting of an electrical cord configured to couple with a corresponding socket of one or more electronic devices, the accessory connector may be a Bluetooth antenna or the like exposed through the "try me" packaging opening, and configured to communicate with the receiver of an electronic device, for example, by means of an infrared signal or any radio frequency detection means.

The foregoing and other objects, features, and advantages of the invention will be apparent from the following, more detailed description of the various embodiments of the invention, as illustrated in the accompanying drawings and photographs.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 3 depicts an elevation view of an outer portion of a front assembly of an adaptor packaging system including an outer front member, an inner second front member and an enclosed adaptor or device accessory member in accordance with an embodiment of this invention.

FIG. 3A depicts an elevation view of an inner portion of the inner front member and a portion of the adaptor accessory member of the adaptor packaging system of FIG. 3.

FIG. 3B depicts an elevation view of a portion of the device accessory member of the adaptor packaging system of FIG. 3.

FIG. 4 depicts an outer portion of a back assembly including an outer back member, an inner back member, and three accessory connector members of the adaptor packaging system in accordance with an embodiment of this invention.

FIG. 4A depicts an elevation view of an outer portion of the inner back member and a portion of the three accessory connector members of the adaptor packaging system of FIG. 4.

FIG. 4B depicts an elevation view of a portion of each of the three connector members of the adaptor packaging system of FIG. 4.

FIG. 6 depicts an elevation view of an inner portion of a front assembly coupled to an inner portion of a back assembly of an adaptor packaging system according to another embodiment of this disclosure.

FIG. 6A depicts an elevation view of an inner front member for insertion into a portion of an outer front member of the adaptor packaging system of FIG. 6.

FIG. 6B depicts an elevation view of an inner back member for insertion into a portion of an outer back member of the adaptor packaging system of FIG. 6.

DESCRIPTION OF THE INVENTION

Figure 1A:
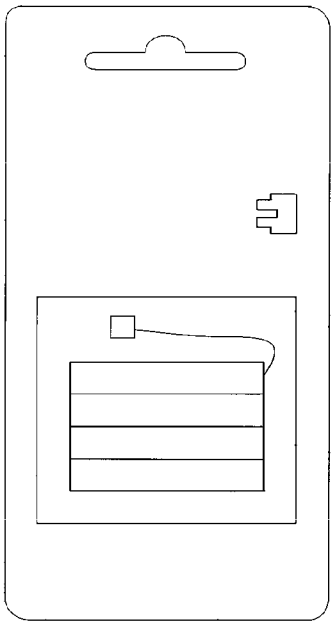
FIGS. 1A-1D illustrate aspects of a prior art packaging system including a merchandising package and an electronic device.
Figure 1B:
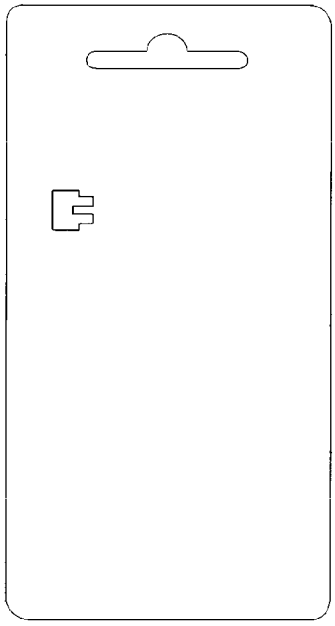
Figure 1C:
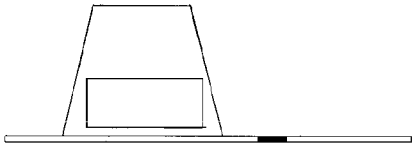
Figure 1D:
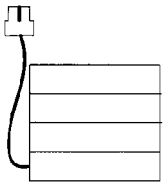

In the following description, numerous specific details are set forth in order to provide a more thorough description of the present invention. It will be apparent, however, to one skilled in the art, that the present invention may be practiced without these specific details. In other instances, well-known features have not been described in detailed so as not to obscure the invention.

For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature may called out in another drawing.

The Figures are numbered and annotated so that one skilled in the art of packaging methods and construction, by reference to the Figures, will easily be able to understand the materials and method of construction and will be able to easily assemble the parts to achieve the functionality shown.

In the Summary and Preferred Embodiments above, the Description of the Invention, and the Claims and Abstract below, and in the accompanying drawings, reference may be made to particular features (including method steps) of the invention. It is to be understood that this disclosure includes most possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can consist of (i.e., contain only) components A, B and C, or can contain not only components A, B and C but also one or more other components.

Where reference is made herein to a method comprising two or more defined steps, the defined steps may be implemented in any order or simultaneously (except where the context excludes that possibility). Moreover, the method may include one or more other steps that may be implemented before any of the defined steps, between two of the defined steps, or after all the defined steps (except where the context excludes that possibility).

The term "at least" as denoted herein means one or more, while the term a "plurality" means two or more.

The term "or" is used herein as a conjunction used to link one or more alternatives in a series of one or more alternatives. The term "and/or" is used herein as a conjunction meaning that either or both of two options may be valid.

The term "and" is used herein as a conjunction to indicate an additional thing, situation or fact.

When used in the appended claims the term "comprising at least one of A and B" as used herein (depending on the context of the specification) may mean: comprising either one of A or of B (and more), or comprising both of A and of B (and more). As in understood in the patent art, "comprising A" means "A and more," while "comprising B" means "B and more." Thus if A is excluded according to the context of the specification in the phrase "comprising at least one of A and B," then A cannot be part of the "and more" and similarly for B if B is excluded according to the context of the specification.

The terms "accessory" and "adaptor" may be interchangeably used with other terms that define a device or apparatus configured for use with a consumer supplied corresponding device or apparatus.

FIGS. 1A-1D illustrate a front elevation (FIG. 1A), Back elevation (FIG. 1B) and side elevation (FIG. 1C) view of a prior art merchandising package along with a front elevation view (FIG. 1D) of an enclosed electronic device according to Lebron, U.S. Pat. No. 6,349,830. As described earlier (see Above Background of the Invention) Lebron disclosed a Merchandising package for portable electronic device accessories, such as battery packs for cordless telephone handsets. Lebron is specifically directed to solving the problem of enabling consumers to check the compatibility of replacement accessories for their portable electronic devices, but without removing the accessory or its connector from a sealed merchandising package. However, Lebron does not accomplish this by using a traditional "try me" feature. Instead, Lebron uses one or another of two types of "dummy" coupling interfaces, as discussed above in the Background of the Invention.

Figure 2:
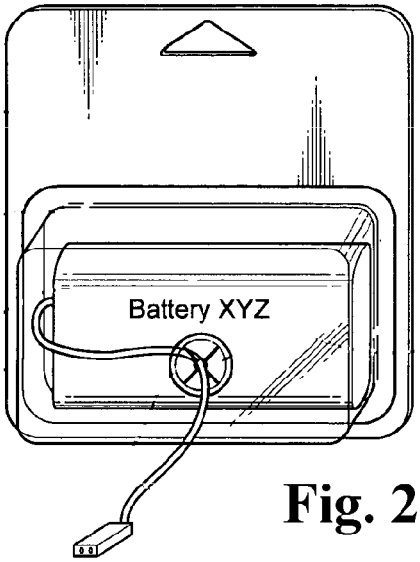
Fig. 2 Prior Art
FIG. 2 illustrates aspects of a second prior art packaging system including a merchandising package and an electronic device.

FIG. 2 illustrates a perspective view of a prior art merchandising package including an electronic device according to Eisenbraun, U.S. Pat. No. 6,968,950 (as also discussed above in the Background of the Invention).

Figure 5:
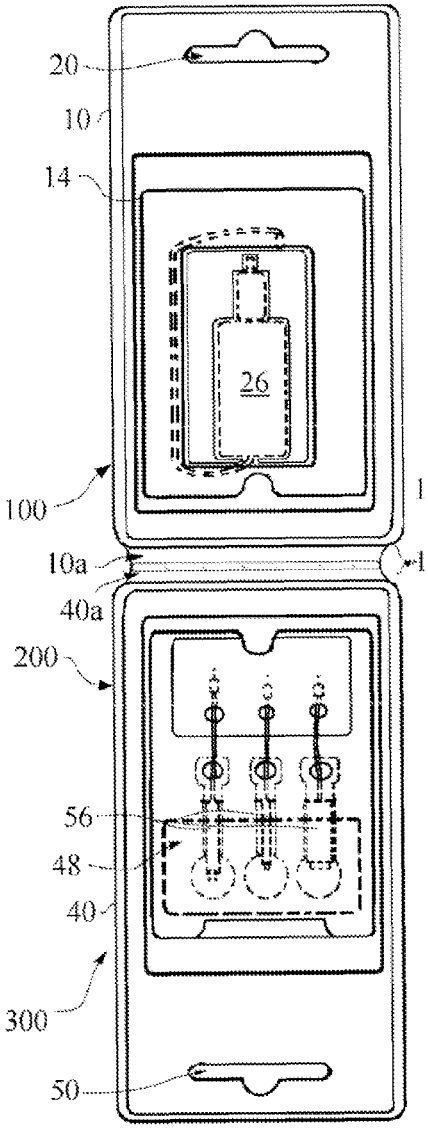
FIG. 5 depicts an elevation view of an inner portion of the front assembly of the adaptor packaging system of FIG. 3 coupled to an inner portion of the back assembly of the adaptor packaging system of FIG. 4.

Referring now to both FIG. 3 and FIG. 4, an adaptor or accessory packaging system 300 (see also FIG. 5 and the description below) may comprise a front assembly 100 and a back assembly 200 and, by referring to FIG. 5, a portion of the front assembly 100 may be coupled to a portion of the back assembly 200. While such a coupling may be accomplished as illustrated, it should be understood that the coupling may be accomplished using any suitable common edge between the front assembly 100 and the back assembly 200.

More specifically, FIG. 3 depicts an elevation view of an outer portion of the front assembly 100. The front assembly 100 may comprise a continuous outer front member 10 (outer surface shown) having a front label insert 12 located behind the outer front member 10. As illustrated, the front label 12 may further have a frame opening (or window) defining a display region 18 for an item to be displayed. Of course, it is understood that the display region 18 may have any suitable shape as desired and understood in the art. Thus, for example, the frame opening 18 may be a circle, oval, two-sided, three-sided and so on. The front label insert (or label member) 12 may hide a portion of an accessory or adaptor 26 displayed in the adaptor packaging system and may be varied in size and shape as desired by a manufacturer. In many situations, the front label insert 12 could be sized to display one or more accessory members (only one adaptor, such as a power adaptor, is shown in FIG. 3). In an aspect, a portion of the surface of the outer front member 10 may include a contour 12*a* defined on the shape of the front label insert 12 (not shown in FIG. 3, but shown in FIG. 6) and may be sized to receive the front label insert. The outer front member 10 may comprise a lip 16. As disclosed herein, without limiting the disclosure, the outer front member 10 may comprise a thermoplastic material, such as polyethylene, polypropylene and the like as is understood in the art. For the purpose of displaying objects and descriptions (not shown) located on the front label insert 12 naturally, the outer front member 10 may comprise a substantially transparent thermoplastic material. Furthermore, since the thermoplastic material may be readily melted or fused, an inner portion of the lip 16 may advantageously be coupled to an inner portion of a second lip 46 of an outer back member 40 (see FIG. 4) with moderate heat as may be required in rapid manufacturing processes as is understood in the art. However, this process may be altered as needed, so that other sealing methods may be used such as using ultrasonic sealing, adhesives and the like.

Referring further to FIG. 3, the front assembly 100 may further comprise an inner front member 14 (shown in dotted lines, because as illustrated in an aspect a portion of the inner front member 14 may be hidden by the front label insert 12). However, of course, as described above, the front label insert 12 could be sized as desired. As illustrated in FIG. 3, an inner portion of that inner front member 14 may be contoured and configured to receive a accessory member 26 (see FIG. 6A and the description below). For example, as illustrated in FIG. 3, an inner portion 22 of the inner front member 14 may have a channel 24 configured to receive a portion of a lead (or cord) (shown in dotted lines because the lead 28 may be hidden by the front label 12). The cord 28 may be coupled to a portion of the accessory member 26. Thus, as illustrated in FIG. 3, it should now be clear that the inner front member 14 may comprise an accessory-receiving region 22*a* configured to receive one or more first accessory members (such a power adaptors or a cellular phone headset) 26 and the region 22*a* may be contoured and have one or more channels 24. The accessory-receiving region 22*a* may be configured to receive a portion of each cord member 28 coupled to a portion of each associated one or more first accessory members. Without limiting the disclosure, the inner front member 14 may comprise any economically viable packaging material such as a thermoplastic that may be formable as desired. Naturally, such a packaging material may be substantially transparent, translucent or substantially opaque as desired.

Referring now to FIG. 3A the inner front member 14 may have a conformed region 22*a* defined by an inner portion (region) of the inner front member 14 sized to receive the first accessory member 26 (see FIG. 6A and the description below). Further, the inner portion 22*a* may have one or more channels 24 (one only shown in FIG. 3A) sized to receive a cord member 28 coupled to a portion of the first accessory member 26 (one only shown in FIG. 3A). Similarly, FIG. 3B illustrates an example of an accessory member 26 having an extension member (or lead or cord) 28 coupled to a portion of the accessory member 26. Further, an end of the cord member 28 may have a plug or socket 28*a* configured to receive a tip connector 58*a* (See FIGS. 4, 4A, 4B and the description below). However, naturally, instead of a female/male plug arrangement as illustrated herein, other appropriate coupling arrangements may be used.

FIG. 4 depicts an elevation view of an outer portion of the back assembly 200. The back assembly 200 may comprise an outer back member 40 (outer surface shown) having a back label insert 42 located behind the outer back member 40. As illustrated, the back label insert 42 may further have an accessible frame opening (or window) defining a display consumer-accessible opening 48 for an item to be displayed and accessed in a "try me" style configuration. Of course, it is understood that the display consumer-accessible opening region 48 may have any suitable shape as desired and understood in the art. Thus, for example, the frame of consumer-accessible opening 48 may be a circle, oval, two-sided, three-sided and so on as described above with regard to the front assembly 100.

However, unlike the front assembly 100 described above where the front assembly 100 covers the inner front member 14 and thus does not permit access to the accessory or adaptor 26, the back assembly 200 permits access by a consumer to at least a portion of one or more accessory connector members (or devices) 56 secured within a portion of the back assembly 200 ("try me" feature). Thus a consumer may access a portion of the connectors 56 without needing to pull out any leads (or cords) 58, since an opposite end (tip 58*a*, FIGS. 4A, 4B) of each of the leads couples to a cooresponding socket (or fitting) 28*a* located at an end (see FIG. 3B) of the accessory's lead (or cord) 28. In other words, in this embodiment, each cord 58 provides greater freedom of choice to use the same accessory member 26.

Referring again to FIG. 4 the back label insert (or member) 42 located behind the outer back member 40 may hide an inner portion of one or more connector members 56 (three shown in FIG. 4 and two shown in FIG. 8) displayed in the accessories packaging system and may be varied in size and shape as desired by a manufacturer. Naturally, the one or more accessory connector members 56 may also be varied in size and shape and may comprise a set of one or more connector members associated with one accessory 26 (as illustrated in FIG. 3). Naturally, the device accessory 26 may be associated with one or more electronic devices (such as cellular phones, MP3 players, laptop computers or any other suitable electronic device). However, it is clearly, understood that the accessories packaging system 300 may have one or more device accessories (including but not limited to power adaptors, battery packs, head phones and the like) 26 in a display area not accessible by a consumer located in one or more inner front members 14 of the front assembly 100 with each of the device accessories having an associated set of one or more accessory connector members 56. Further, each of the one or more accessory connector members 56 may have a proximal end 58*a*visible and accessible through the one or more window displays 48 located in a portion of the outer back member 40 of the back assembly 200.

In an aspect, a portion of the surface of the outer back member 40 may include a contour 48*a* (not shown in FIG. 4, but see FIG. 6) sized to receive the back label insert 42. The outer back member 40 may comprise a lip 46. As disclosed herein, without limiting the disclosure, the outer back member 40 may also comprise a thermoplastic material, as described above. The outer back member 40 may comprise a substantially transparent thermoplastic material to display objects as well as product descriptions and instructions (not shown) located on the back label insert 42.

Referring further to FIG. 4, the back assembly 200 may further comprise an inner back member 44 (shown in dotted lines). As illustrated in this aspect of the disclosure a portion of the inner back member 44 may be hidden by the back label insert 42. However, of course, as described above the back label insert 42 could be sized as desired. As illustrated in FIG. 4, a first portion 52*a* of the inner back member 44 may include one or more inner portions 52 contoured and configured to receive one or more accessory connector members 56. For example, as illustrated in FIG. 4, each inner portion 52 of the inner back member 44 may have a first contoured end contiguous with a channel 54 configured to receive a portion of the accessory connector member 56. An opposite end of each inner portion 52 contiguous with the channel 54 may have an opening 54*a* located at an opposite end of the inner portion 52. Further, a portion of an end (plug) 58 *a* of each lead (or cord) 58 (shown in dotted lines since the leads may be hidden by the back label 42) may be threaded through each corresponding opening 54*a* behind the inner back member 44.

With reference to FIG. 4, the inner back member 44 may have a second contoured portion 48*a* (FIG. 6B and the description below) having an opening 48*b*. A portion of each lead 58 may be further threaded through the opening 48*b* thereby securing the lead 58 to the inner back member 44 to prevent the cord (or lead) 58 from being easily pulled out by a consumer.

Thus, as illustrated in FIG. 4, it should now be clear that in the back assembly 200, the outer back member 40 has a consumer-accessible opening 48. Further, the inner back member 44 may be located behind (interior of) the outer back member 40 and may comprise one or more consumer accessible regions 52*a* configured to receive one or more accessory connector members 56. Further, regions 52*a* may be contoured and have one or more channels 54 configured to receive a portion of one or more leads 58 that may be or be coupled to a portion of cord 28 or an end 28*a* (see description above and FIGS. 3, 3A, 3B) of one or more of the first accessory members 26 located in an inner front member 14 displayed behind a consumer non-accessible outer front member 10. Without limiting the disclosure, the inner back member 44 may comprise any economically viable packaging material such as a thermoplastic that may be formable as desired. Since, there is a consumer-accessible opening 48 in the outer back member 40, there is no requirement that the thermoplastic material be transparent. However, as a matter of economic consideration, an economically viable alternative would be to form both the outer front member 10 coupled to a portion of the outer back member 40 having the opening 48 in a molding operation, such as injection molding and the like as is well understood in the art (as described below with reference to FIG. 5).

Referring now to FIG. 4A the inner back member 44 may have one or more receiving regions 52*a* located in an inner portion of the inner back member 44 sized to receive the one or more accessory connector members 56. Further, each of the receiving regions 52*a* may have one or more channels 54 sized to receive a portion of each of the accessory connector members 56 and a portion of one or more leads 58 coupled to a portion of each one of the ends of the displayed accessory members 56. Further, a portion of an opposite end of each of the accessory connector members 56 such as a cord 58 may comprise a common connector tip 58*a* at a opposite end of the cord to secure each of the accessory connector members 56 to a portion 48*a* of the inner back member 44. It should be further noted that the inner back member 44 might have the same features as the inner front member 14, and include the same features such as the opening 32 to better register the inner front member 14 to the inner back member 44. FIG. 4B depicts each of three accessory connector members 56 as described above. A distal end of each accessory connector member 56 may include a plug or accessory connector 56*a* configured to couple to one or more electronic devices. An opposite proximal end of each accessory connector member 56 comprises a common connector tip 58*a* configured to couple to an end of a cord 28 having a receiver end device socket 28*a* of one or more accessory members 26.

FIG. 5 depicts an inside elevation view of an inner portion of the front assembly 100 of the accessories packaging system 300 coupled to an inner portion of the back assembly 200 of the accessories packaging system. The description of individual components of each assembly is the same as noted above, but clearly illustrated as being from an inner side point-of-view rather than the outer view described previously. As illustrated, the outer front member 10 may have a front member extension 10*a*, while the outer back member 40 may have an extension 40*a*. Of course, each of the extensions may be contiguous and merely be creased or shaped so that an inner portion of the front assembly 100 may be folded against an inner portion of the back assembly 200 (see FIG. 5B). As a matter of convenience, the extension 150 coupling the front assembly 100 to the back assembly 200 corresponds to the front member extension 10*a* contiguous with the back member extension 40*a*. When folded in this way, one or more edges of the outer front member 10 may be coupled to one or more of the edges of the outer back member 40 as described above. Of course, any joining method including simple mechanical stapling may be used.

Figure 5A:
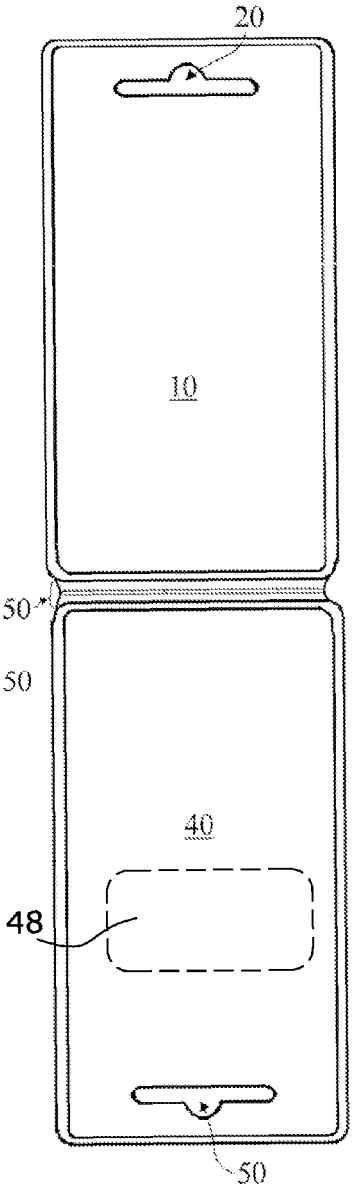
FIG. 5A depicts an elevation view of an inner portion of the outer front member of the adaptor packaging system of FIG. 3 coupled to an inner portion of the back member of the adaptor packaging system of FIG. 4.
Figure 5B:
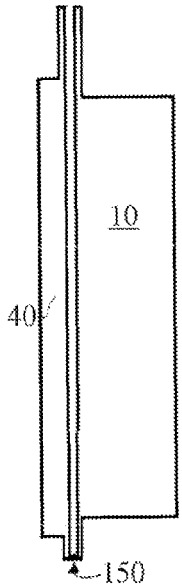
FIG. 5B depicts a side elevation view of an outer portion of the outer front member of the adaptor packaging system of FIG. 3 coupled to an outer portion of the back member of the adaptor packaging system of FIG. 4A.
Figure 5C:
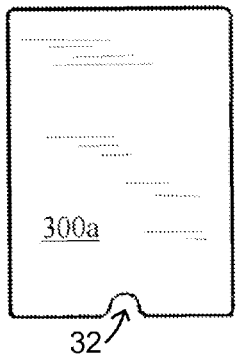
FIG. 5C depicts an elevation view of a separator member.

FIG. 5A depicts a portion of an end of the outer front member 10 coupled to a portion of an end of the outer back member 40 with an adjacent extension 150 located between each of the ends. FIG. 5B depicts a side elevation view of an outer portion of the outer front member 10 of the accessories packaging system 300 coupled to an outer portion of the outer back member 40 by the extension 150. FIG. 5C depicts an elevation view of a separator member 300*a*. The separator member 300*a* may be located between a portion of each of the outer front member 10 and the outer back member 40. The separator member 300*a* may have the opening 32 to align (or register) the outer front member 10 and the outer back member 40.

FIG. 6 depicts an elevation view of an inner portion of a front assembly coupled to an inner portion of a back assembly of another embodiment of an accessories packaging system 300. The outer front member 10 has an opening 20 as before, with an inner edge 12*a* of the front label 12 defining a contour to align the front label to an inner portion of the outer front member 10. In the same way, the outer back member 40 has an opening 50, with an inner edge 44*a* of the back label defining a contour to align the back label to an inner portion of the outer back member 40. Of course, the display window 48 is consumer accessible to provide the "try me" feature as described above. As described above, an end of each of the outer front member 10 and the outer back member 40 may have an adjacent extension 10*a*, 40*a* together denoted a hinge 150 to provide a clamshell package. When adjacent to each other in an accessories packaging system, the openings 20, 50 facilitate neat hanging of the accessories package system for substantially tamper resistant display in a retail outlet.

FIG. 6A depicts an elevation view of an embodiment of an inner front member 14 for insertion into a portion of the outer front member 10 of the accessories packaging system. As illustrated, a contoured region 22*a* of the inner front member 14 may be extended away (above or below) a substantially adjacent region including a portion 14*a*, an inner portion 22 and a channel 24. An inner edge of the contoured region 22*a* defines the inner portion 22 adjacent to the channel 24.

FIG. 6B depicts an elevation view of an embodiment of an inner back member 44 for insertion into a portion of an outer back member 40 of the accessories packaging system. As illustrated, the inner back member 44 may comprise a region 44*a* adjacent to each of two inner portions 52 contoured and configured to each receive one accessory connector member 56. The inner portion has an opening 54*a* as described previously. Another inner region 48*a* has two openings 48*b* as described previously. An end of the inner back member 44 may have an indentation 32*a* located at an opposite end to the end having the alignment opening 32 (described previously). Each bottom surface of the regions 32*a*, 52 and 48*a* are substantially adjacent to one another and may be defined as indentations of the surface of the region 44*a*. In other words, the surface of the region 44*a* may be elevated relative to the regions 32*a*, 52 and 48*a*.

Figure 7:
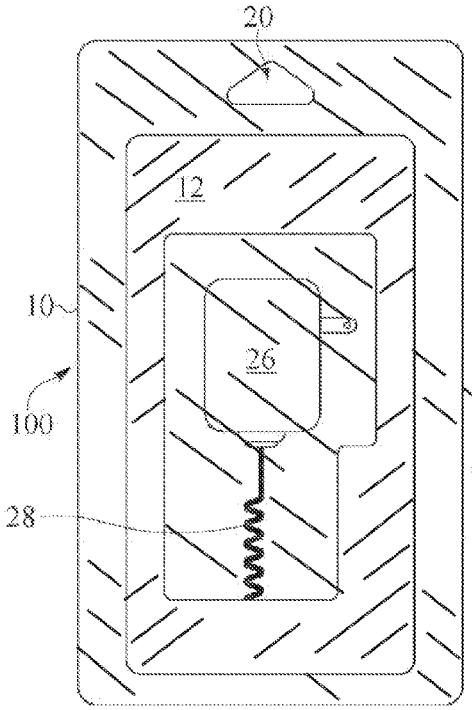
FIG. 7 depicts a front elevation view of the adaptor packaging system of FIG. 6 including a device accessory member.

FIG. 7 depicts a front elevation view of an embodiment of the front assembly 100 of the accessories packaging system. The front assembly may include a device accessory 26 and a front label 12 as viewed from an outer surface of the outer front member 10. The front label 12 may comprise appropriate merchandising and identification information to provide consumer convenience in selection of a needed accessory.

Figure 8:
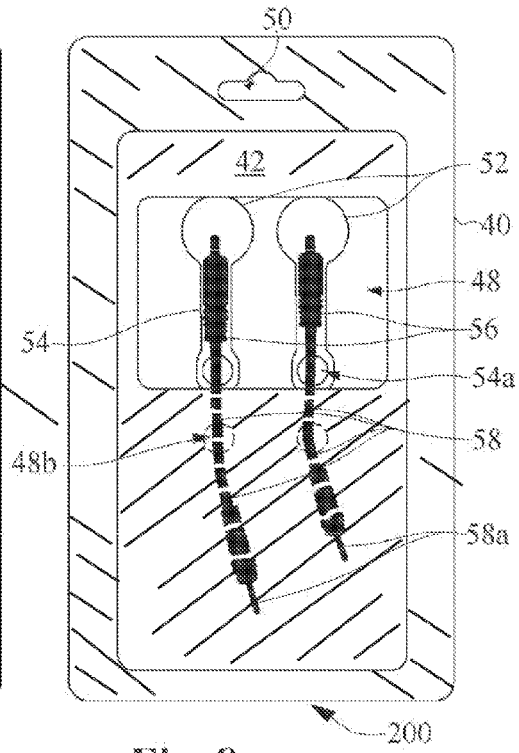
FIG. 8 depicts a back elevation view of the adaptor packaging system of FIG. 6 including two accessory connector members.
Figure 9:
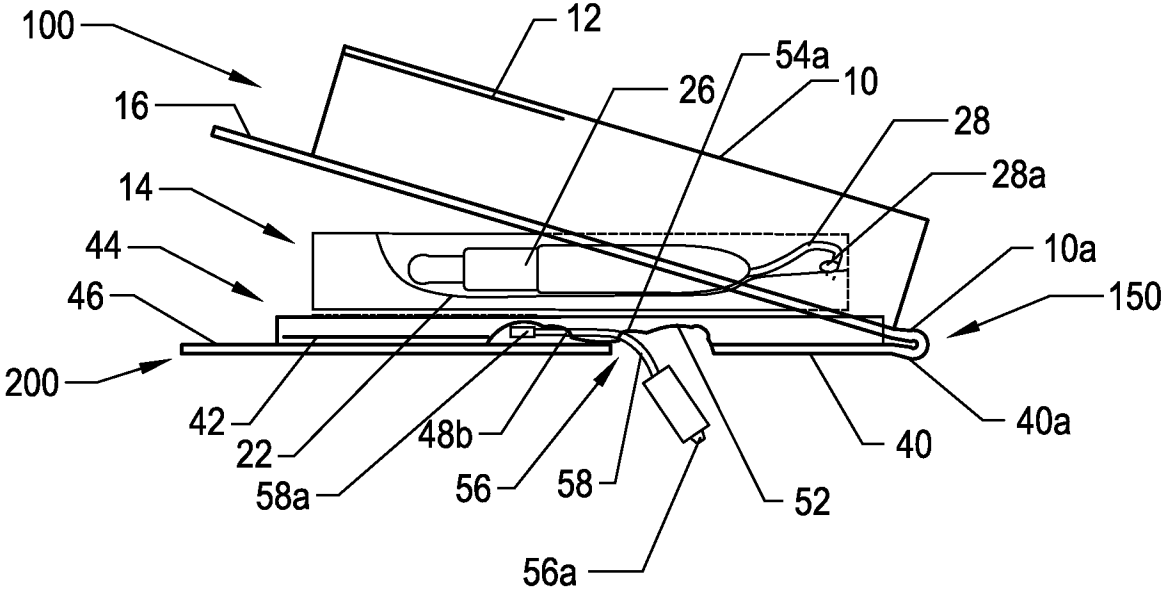
FIG. 9 illustrates a side view of the adapter or accessory packaging system shown in FIGS. 3 and 4.

FIG. 8 depicts an elevation view of an embodiment of the back assembly 200 of the accessories packaging system. As illustrated in FIG. 8, the back assembly 200 may include each of two accessory connector members 56 and a back label 42 as viewed from an outer surface of the outer back member 40. The back label 42 may comprise appropriate merchandising and identification information to provide consumer convenience in selection of a needed accessory and includes a "try me" opening 48 accessible by a consumer to match up to the consumer's electronic device. As illustrated in FIG. 8, each lead 58 may be threaded through openings 54*a*, 48*b* to secure each of the two accessory connector members 54 to the back member 40.

As may be appreciated, from the description herein, providing a "try me" feature (specifically the consumer-accessible window 48) located on a portion of the outer back member 40 of the accessories packaging system may result in increased visibility of certain features of a product display (such as the one or more accessory connectors 56 described herein).

Advantageously, when the "try me" feature is conveniently located on a portion of the back assembly 200, it may provide more room for labeling the accessories packaging system, to benefit both a consumer and a retailer. Thus, there may be better branding by manufacturers of accessories and may be an advantage for consumers in that a family of products with which the accessories are compatible (e.g., Sony Ericsson—all models) may be more prominently set forth.

In another aspect, when the "try me" feature is located on a portion of the back assembly 200 of the accessories packaging system such as the outer back member 40, multiple accessory connectors may be displayed at once in sets associated with their specific accessory 26 to the benefit of consumers and manufacturers. In a specific example, where an accessory 26 had been sold with two, three or four connectors to make the accessory compatible with more portable electronic devices, all of the connectors would be displayed in the "try me" one or more openings. Naturally, it will be appreciated that this may greatly increase the size of the "try me" feature.

In yet another aspect, when the "try me" feature is located on a portion of the back assembly 200 of the accessories packaging system, neatness of product display to consumers may be enhanced over time (also known as "shelf discipline"). For example, typically when consumers use "try me" features enabling them to pull on a connector cord to reach a portable electronic device being tested, often consumers cannot be relied upon to push the cord (such as an accessory connector lead 58) neatly back into the package when finished using the "try me" feature. This means retail employees may need to be diverted from their selling activities more often because as often happens, accessory connectors may be left unattractively hanging out of the product packages being displayed. Often, if the "try me" feature is located on a portion of the front assembly 100 of the accessory package system, product display may be impaired, making a retail outlet appear sloppy and undisciplined.

While the invention has been particularly shown and described with reference to preferred embodiments thereof, it will be understood by those skilled in art that the foregoing and other changes in form and details may be made therein without departing from the spirit and scope of the invention. The scope of the present invention is not intended to be limited by the specific examples set out herein.

What is claimed is:

1. An electronic device accessory packaging system comprising:

a device accessory comprising an accessory member, a first cord, and a first dedicated connector coupled to said first cord, wherein said device accessory is packaged within said packaging system;

a back assembly comprising an outer back member and an inner back member; wherein said outer back member is configured with a consumer-accessible back opening that is adapted to allow consumer access to said first dedicated connector; wherein said inner back member is sized and configured to fit within said outer back member; wherein said inner back member comprises at least one contoured inner portion configured to receive said first dedicated connector; and wherein said at least one contoured inner portion is exposed through said consumer-accessible back opening;

a front assembly comprising a continuous outer front member lacking any consumer-accessible front opening on the front portion of said front assembly; wherein said outer front member is configured to cooperate with said outer back member to form said packaging system; wherein said formed packaging system defines an interior cavity of sufficient size for receiving said accessory member; wherein said at least one contoured inner portion has a recess of sufficient depth and width to hold said first dedicated connector within said interior cavity below the plane of the outer back surface of said outer back member; wherein said accessory member is contained within said interior cavity; wherein said first cord extends from said interior cavity to said consumer-accessible back opening; wherein said first dedicated connector is supported within said at least one contoured inner portion exterior of said interior cavity, thereby allowing consumer access to said first dedicated connector through said consumer-accessible back opening.

2. The packaging system to package a device accessory, as recited in claim 1, wherein said front assembly further comprises an inner front member configured to fit within the front portion of said interior cavity and wherein said inner front member is configured to secure at least a portion of said device accessory.

3. The electronic device accessory packaging system, as recited in claim 1, wherein said device accessory comprises a second dedicated connector; wherein said at least one contoured inner portion comprises at least a first and a second contoured inner portion configured to receive said first dedicated connector and to receive said second dedicated connector, respectively; and wherein said first contoured inner portion, said second contoured inner portion, said first dedicated connector, and said second dedicated connector are exposed through said consumer-accessible back opening.

4. The electronic device accessory packaging system, as recited in claim 2, wherein said inner front member comprises an inner contoured accessory-receiving region and wherein said accessory member is supported within said inner contoured accessory-receiving region.

5. The electronic device accessory packaging system, as recited in claim 2, wherein said inner front member is configured with a front channel to receive a portion of said device accessory and wherein said first cord is received by said front channel.

6. The electronic device accessory packaging system, as recited in claim 1, wherein said outer front member is generally transparent to permit visual identification of said device accessory packaged within said packaging system.

7. The electronic device accessory packaging system, as recited in claim 1, further comprising a substantially planar separator member disposed between said outer front member and said outer back member, wherein said separator member comprises a substantially flat panel with an outer edge curved inwardly to define an alignment opening.

8. The electronic device accessory packaging system, as recited in claim 6, further comprising a front label carrying consumer information.

* * * * *